United States Patent [19]

Axel

[11] 4,234,092

[45] Nov. 18, 1980

[54] CONTAINER

[76] Inventor: Edwin Axel, 8707 Carlisle Rd., Wyndmoor, Pa. 19118

[21] Appl. No.: 897,770

[22] Filed: Apr. 17, 1978

[51] Int. Cl.[3] ..... B65D 81/02; B65D 85/30

[52] U.S. Cl. ..... 206/523; 206/583; 206/586; 206/591; 220/4 E; 220/4 D

[58] Field of Search ..... 206/591, 592, 521, 564, 206/583, 593, 586, 587, 509, 511, 523; 220/23.8, 4 B, 4 E, 4 D, 453

[56] References Cited

U.S. PATENT DOCUMENTS

| | | | |
|---|---|---|---|
| 2,808,189 | 10/1957 | Williams | 206/592 |
| 3,292,884 | 12/1966 | Scheldorf | 206/583 X |
| 3,344,973 | 10/1967 | Studen | 220/453 |
| 3,531,040 | 9/1970 | Myny | 206/586 X |
| 3,557,489 | 1/1971 | Ferrand | 220/4 E X |
| 3,616,943 | 11/1969 | Brink | 206/511 X |
| 3,669,337 | 6/1972 | Struble | 206/583 X |
| 3,705,222 | 12/1972 | Rogers et al. | 220/4 E X |
| 3,747,751 | 7/1973 | Miller et al. | 206/564 X |
| 3,999,661 | 12/1976 | Jones | 206/591 |
| 4,013,170 | 3/1977 | Hutterer | 206/583 X |
| 4,061,228 | 12/1977 | Johnson | 206/591 X |
| 4,113,096 | 9/1978 | Scott | 206/586 X |

FOREIGN PATENT DOCUMENTS

| | | | |
|---|---|---|---|
| 49-4268 | 2/1974 | Japan | 206/592 |
| 475299 | 11/1937 | United Kingdom | 206/583 |

*Primary Examiner*—Joseph Man-Fu Moy
*Attorney, Agent, or Firm*—Walter B. Udell

[57] ABSTRACT

An external protective shell shipping container into which is loaded a tightly closed primary container for dangerous materials. The protective container is designed to withstand crushing and impact loads in excess of those anticipated in the event of accident, and is also so designed that cracking or breaking of the external shell is taken into account to provide a part of the energy absorbing container design. The external contouring of the container shell avoids sharp corners and provides rounded and sloping surfaces for optimum shock load distribution.

The illustrated container is for a long narrow load supported on shock mounts in a free float position within the shell container, the support points being inward from the ends which cantilevers the ends of both the outer shell container and the interior container. A special controlled crush structure is incorporated into the ends of the shell container, and special external contouring provides for ease of handling by fork lift vehicles. The shell container is made of identical top and bottom molded fiberglass half sections secured together after installation of the interior load into the bottom half section. Molded into the shell container sections are vertical detents for stabilization of a number of the shell containers when stacked to prevent relative shifting.

14 Claims, 6 Drawing Figures

CONTAINER

This invention relates generally to containers, and more specifically to large size shipping containers for safely carrying elongated heavy structures.

Because of todays technology, there now exist many materials which can be highly dangerous both to animal life and to the environment if allowed to disperse into the air or the ground, such materials including for example highly toxic liquids which vaporize at normal pressures and temperatures and radioactive materials. The shipment of such substances is effected by confining such materials in tightly sealed containers. There exists however the possibility of rupture to such containers due to accidents which can occur during loading and unloading and actual transportation by truck, rail, or boat. The shipping container according to the invention is an external protective shell into which is loaded the tightly closed primary container for the dangerous material. The container is designed to withstand crushing and impact loads far in excess of those anticipated in the event of accident, and is also so designed that cracking or breaking of the external shell container, while not necessarily desired, is taken into account to provide a part of the energy absorbing container design. The external contouring of the container shell avoids sharp corners and provides rounded and sloping surfaces for optimum shock load distribution.

The illustrated container incorporates a design for a long relatively narrow load supported on shock mounts in a free float position within the shell container, the support points being inward from the ends which shorten the supported beam length and cantilevers the ends of both the outer shell container and the interior container. This construction permits a calculated amount of energy absorbing movement of the shell container opposite ends before transmission of any loading to the interior container. A special controlled crush structure is incorporated into the ends of the shell container, and special external contouring provides for ease of handling by fork lift vehicles. The container is made of identical top and bottom molded fiberglass half sections which are secured together after installation of the interior load into the bottom half section. Molded into the shell container sections are vertical detents for stabilization of a number of the shell containers when stacked to prevent relative shifting. Also provided is a chain plate to prevent gouging of the shell container by hold-down chains which are secured to the transporting vehicle to prevent load shifting.

A primary object of the invention is to provide a novel shipping container for hazardous materials contained within a separate container to be protectively housed within the shipping container.

Another object of the invention is to provide a novel shipping container as aforesaid wherein the interior container is protected from rupture when the shipping container is subjected to severe impact loads from any direction.

A further object of the invention is to provide an novel shipping container as aforesaid wherein the container is formed from identical top and bottom half sections of reinforced molded plastic.

The foregoing and other objects of the invention will become clear from a reading of the following specification in conjunction with an examination of the appended drawings, wherein.

In the several figures, like elements are denoted by like reference characters.

Figure 1:
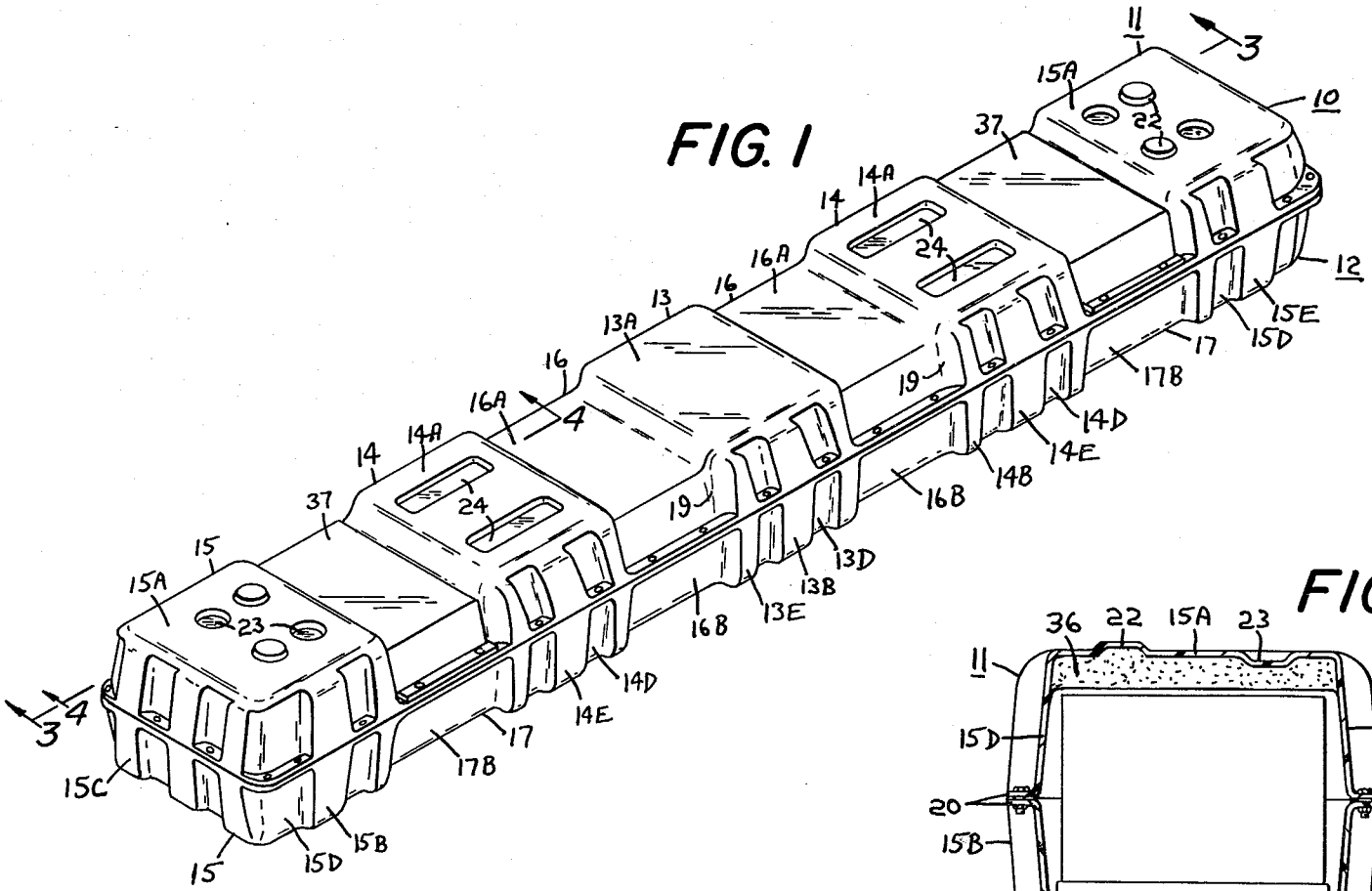
FIG. 1 is an isometric view from above of the shipping container according to the invention.

Referring now to the drawings, there is seen a container designated generally as 10 in the general form of an elongated rectangular parallelepiped having a top section 11 and a bottom section 12, the top and bottom sections being identical and pullable from the same mold. The top and bottom are each formed by a series of spaced apart pan formations connected by intervening trough sections, the pan formations being designated as a central pan 13, a pair of intermediate pans 14 and a pair of end pans 15. The central pan 13 and intermediate pans 14 are connected by a pair of inner troughs 16, while the intermediate pans 14 and end pans 15 are interconnected by the outer troughs 17.

Each of the pans and troughs has a base wall connected to a pair of side walls, all of the base walls being connected to one another and forming the composite top and bottom of the container section, while the side walls are joined to one another and form the sides of the top and bottom sections. The base walls are designated by the proper reference character followed by the letter A, such as the base walls 15A, and the side walls are designated by the reference character followed by the letter B as for example 16B. Additionally, the end pans 15 have end walls 15C which form the end of the top and bottom sections.

Figure 2:
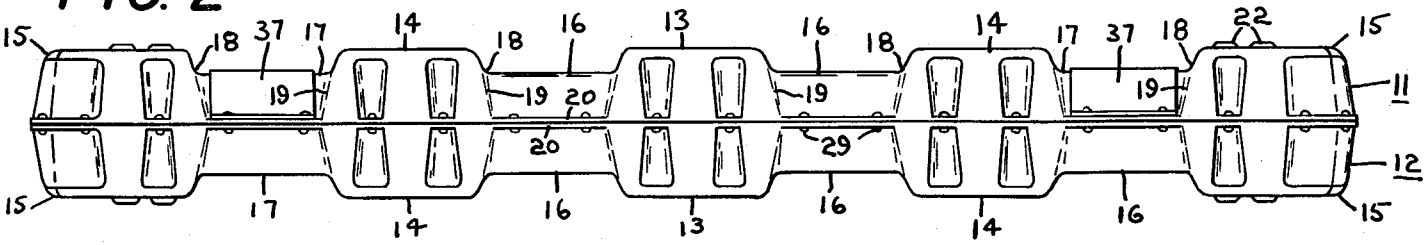
FIG. 2 is a side elevation of the shipping container seen in FIG. 1.
Figure 3:
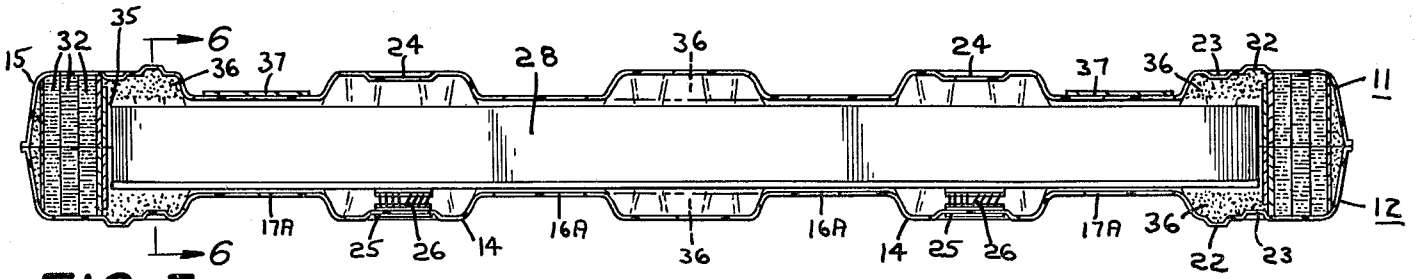
FIG. 3 is a longitudinal vertical section through the shipping container of FIG. 1 as would be seen when viewed along the lines 3—3 thereof.
Figure 4:
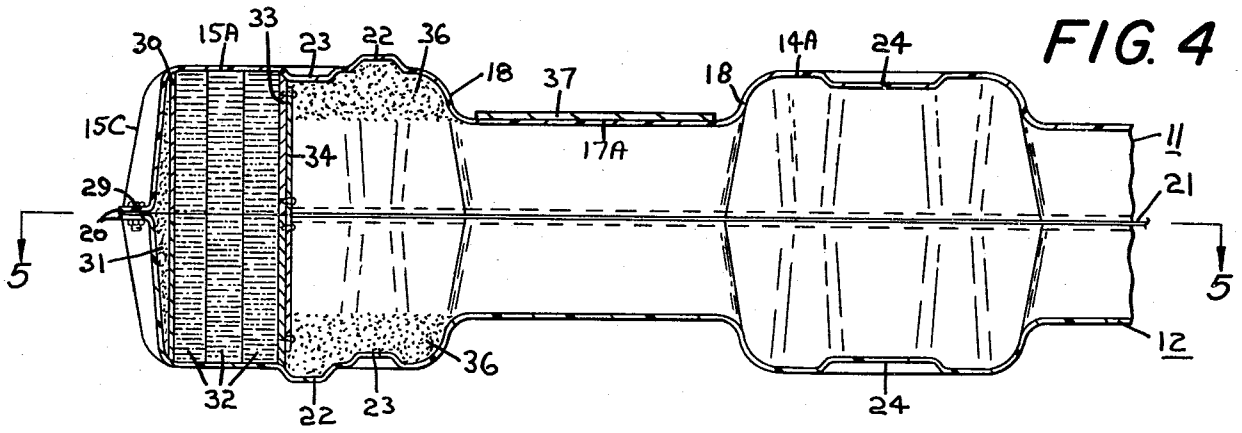
FIG. 4 is an enlarged longitudinal vertical sectional view through the container of FIG. 1 along the same section line as that of FIG. 3 but encompassing only a portion of the length of the container, as would be seen when viewed along the lines 4—4 of FIG. 1.
Figure 5:
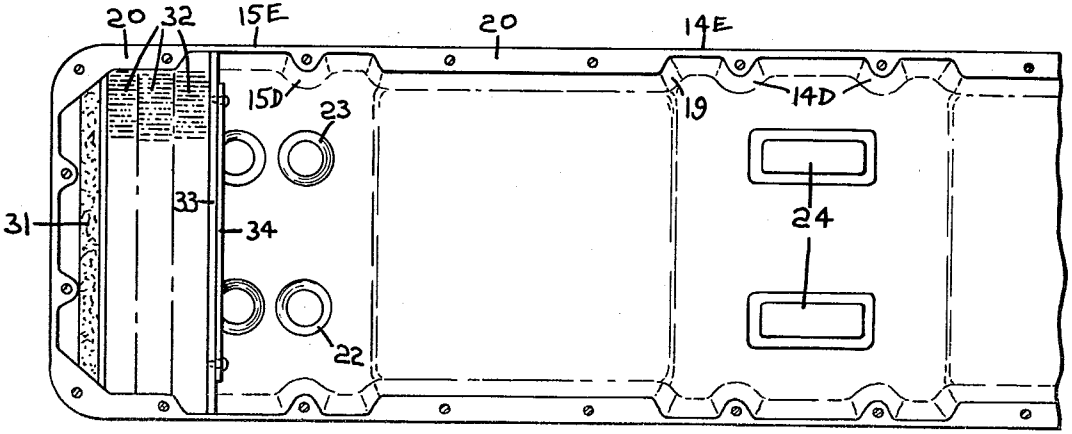
FIG. 5 is a top plan view of a portion of the bottom section of the container as would be seen when viewed along the lines 5—5 of FIG. 4.

As best seen in FIGS. 2, 3 and 4, the base walls of the pans and troughs are connected by rounded contour transition sections 18, and as best seen in FIG. 5 the side walls of the pan and trough sections are interconnected by smoothly contoured transition sections 19. As also best seen FIGS. 1 and 5, the side walls of all the troughs are substantially coplanar and coplanar with portions of the side walls of the pans, which latter are designated by the letters D, while other portions of the side walls of the pans extend to a widthwise greater extent and define the maximum width of the top and bottom sections, these portions of the side walls being designated by the letter E.

The lateral distance between the widthwise extent of the trough side walls 16B and 17B on the one hand and the maximum width of the section corresponding to the maximum width pan side walls is occupied by the bolting flange 20 which extends completely around the periphery of the top and bottom sections in the indicated regions. A sealing gasket of rubber or other suitable material 21 is disposable between the flanges 20 to render the interior of the container water and vapor tight.

Figure 6:
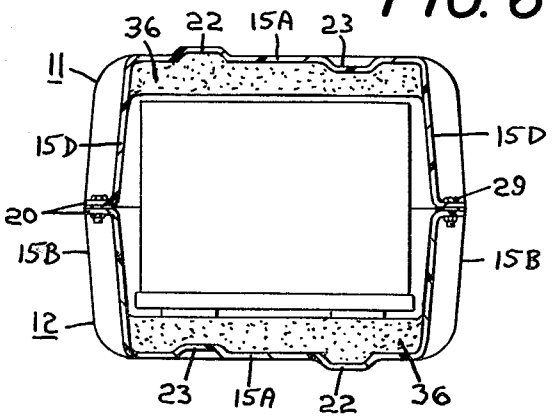
FIG. 6 is a transverse vertical cross section through an end compartment of the container structure as would be seen when viewed along the line 6—6 of FIG. 3.

As best seen from FIGS. 1, 4 and 6 the transverse shape of the top and bottom sections 11 and 12, whether through one of the troughs or one of the pans, is seen to be trapezoidal with the smaller base being located at the base wall and the larger trapezoidal base being at the flange position. Similarly, as best seen in FIG. 5, the interconnections between the base walls of the pans and the troughs cause the pans to be also trapezoidal in longitudinal section and at the end pan end walls. The contouring of the side walls and the transitions between the base walls of the pans and troughs provide greatly increased compression and anti-twist resistance to the container, while causing the bolting flange 20 to be effectively recessed into the side wall. This protects the flange from break-off resulting from side faced impacting because substantially all of the impact is taken along the extended widthwise faces of the pan sections. The trapezoidal cross-sections and rounded corners also provide needed strength for impact resistance and shock distribution.

The base wall of each of the end pans 15 is formed with a rectangular array of two raised pads 22 and two depressed dishes 23, the pads being along one diagonal of the rectangle and the dishes being along the other diagonal of the rectangle. From FIG. 1 it is seen that the pads 22 are oriented along the same diagonal of the rectangle at both end pans 15, and similarly the dishes 23 are oriented along the opposite diagonal. Accordingly, as is shown in the section of FIG. 3, the pads 22 on the bottom section 12 occupy the same positions as the dishes 23 of the top section 11, while the dishes 23 of the bottom section 12 occupy the same positions as the pads 22 of the top section 11. This provides an interfitting nesting arrangement between the pads 22 and dishes 23 of stacked containers 10, locking the stacked containers against relative lateral shifting.

As best seen in FIGS. 1, 4 and 5, each of the intermediate pans 14 has a pair of rectangular depressions 24 formed in the base wall 14A. These depressions accept rectangular steel plates 25 shown in FIG. 3, these plates acting as large area reinforcements for shock mounts 26 which are seen in FIGS. 3 and 6. The shock mounts 26 and reinforcing plates 25 are securely bolted together through the wall of the rectangular depressions 24, and the upper face of the shock mount 26 is securely bolted to a steel frame 27 which latter is rigidly secured to the interior container 28, the container 28 being that for which the protection is intended. The shock mounts 26 support the container 28 with whatever clearance is desired above the inside faces of the trough base walls 16A and 17A, clearances of one-half inch to one inch being typical. As best seen from FIG. 3, the rigid securements between the interior container 28, steel frame 27, shock mounts 26 and the bottom section container pans 14 materially rigidifies the container bottom section 12 for the entire span between the shock mounts, and hence rigidifies the entire container including the top section 11 when the top and bottom sections are bolted together through the bolting flange 20 as by means of the bolts 29. The ends of the interior container 28 which lie outward beyond the shock absorbers 26 and extend into the end pans 15 are free end cantilevered.

The end structures formed by the end pans 15 of the top and bottom sections 11 and 12 are specially designed to withstand severe impact loads to protect the interior container 28. The kinds of stresses which the container pan must be capable of absorbing while protecting the interior container 28 are best understood by considering the typical size and weight conditions of the containers. The interior container 28 may be approximately fifteen and a half feet long by twenty inches wide by thirteen inches high and weigh approximately two thousand pounds. The outside container 10 may be approximately seventeen and a half feet overall in length and thirty inches wide and twenty-four inches high at maximum dimensions which would be through the pan sections. The inside dimensions would be approximately twenty-two inches wide and fifteen inches high between the base walls of the trough sections so that there exists about one inch clearance between the outside top and bottom and side faces of the container 28 and the inside proximate surfaces of the container 10.

The interior container 28 must be protected from damage under the conditions where the entire package experiences a long drop onto a very hard surface, a drop of perhaps thirty feet. It is not important that the outer container 10 remain intact and undamaged after such a drop, but that the interior container 28 remain undamaged. Accordingly, the end structure of the container 10 is designed to withstand impact loads which would be experienced under such conditions. Referring particularly now to FIGS. 3,4 and 5, there is seen a specially constructed shock absorbing end section which consists of a fiber glass reinforced wood plate 30 spaced slightly in from the end face 15C of each of the end pans 15, rigid polyurethane foam 31 formed in place between the plate 30 and the pan end wall 15C, three sections of honeycomb material 32 each approximately three inches in length with the cell axis of the honeycomb oriented lengthwise of the container 10, a fiberglass reinforced wood plate 33 at the inward end of the honeycomb structure 32, and a steel plate 34 secured to the wood plate 33, this entire structure being locked in place by a layer of fiberglass reinforced plastic. The polyurethane foam 31 while being rigid, as distinguished from a pliable foam, is nevertheless crushable under impact. The honeycomb material 32 is suitably made of kraft fiber phenolic resin impregnated, with a cell diameter on the order of one half inch.

As best seen in FIG. 3, a clearance space 35 is arranged between the end of the interior container 28 and the steel plate 34, this clearance space being on the order of one half inch to one inch. The space should be large enough so that some end deformation of the container 10 can occur before pressure is brought to bear on the end of the container 28, but the space should not be so great that a high impulse force will be exerted on the end of the container 28 by the steel plate 34. The end loading is basically absorbed by the container casing and the honeycombs 32, the latter being intended to crush and absorb the energy of impact.

As best seen in FIGS. 3, 4 and 6, the end pans 15 are also provided with foamed polyurethane 36 in the spaces between the base wall and side walls of the pan to a depth approximately coplanar with the inside surfaces of the base walls 17A of the outer troughs 17. The foamed urethane pads 36 spread the stress along the top or bottom faces of the interior container 28 in the event that the outer container 10 impacts at a non-vertical or non horizontal angle, and prevents the portion of the end pans 15 which lies outward of the end of the interior container 28 from shearing off and exposing the end of the interior container to subsequent impact. If desired, plastic foam or other shock absorbent material could be placed in the hollows of the central and intermediate pans 13 and 14, although this is not as significant as the placement of the foam 36 into the end pans 15.

Each of the troughs 16 and 17 and the central and intermediate pans 13 and 14 is approximately twenty-three inches in length while the end pans 15 are slightly longer. The lengths of the troughs and pans are established to readily accomodate the blades of a fork-lift truck on opposite sides of the central pan 13 in the spaces beneath the inner troughs 16, the out-to-out spacing of fork-lift blades being approximately four feet. The length of the troughs is sufficient to accomodate position variance and angled approach by the fork-lift operator. The vertical distance between the base walls of the troughs and the base walls of the pans is approximately four inches to provide the needed vertical clearance so that the fork-lift operator can avoid running the fork-lift blades into the sides of the container 10.

A pair of chain plates 37, contoured to overlie the troughs 17, are bolted to the top section 11 with the same bolts as secure the top and bottom sections together through the bolting flange 20. The plates 37 may suitably be made of ⅛" to 3/16" steel and prevent gouging and abrasion of the plastic container by hold-down chains used to secure the containers to the transporting vehicles.

The container 10 is preferably made of molded reinforced plastic such as polyester resin with glass cloth and chopped fibers, the wall thickness being suitably from about 3/16" to 5/16", and may be reinforced if desired in suitable places with formed metal inserts or carbon boron fibers.

Having now described my invention in connection with a particularly illustrated embodiment thereof, modifications and variations of my invention may now naturally occur from time to time to those persons normally skilled in the art without departing from the essential scope or spirit of the invention, and accordingly it is intended to claim the same broadly as well as specifically as indicated by the appended claims.

What is claimed to be new and useful is:

1. A protective container for holding an object to be protected from damaging impact, comprising in combination, (a) a hollow top section (b) a hollow bottom section comprising a pair of colinearly spaced apart pan shaped end sections each having a base wall and end and side walls and at least one pan shaped central section colinear with said end sections, each end section being joined to said at least one central section by a generally U-shaped trough section, said at least one central section and trough sections each having a base wall and side walls and the pan sections walls being absent at the junctures with the trough sections so that said bottom section is open from one end wall to the other between the side walls, the base walls of at least said end sections being coplanar at a first level and the base walls of said trough sections being coplanar at a second and higher level, whereby when said bottom section is seated flatwise on an underlying surface there exists a vertical clearance between the surface and the base walls of said trough sections, (c) shock absorbing means secured within said bottom section to which the object to be protected is securable in a free floating position, (d) shock-absorbing end structures at opposite ends of and within said container positioned to closely face each end of the object to be protected, and (e) means for fixedly securing said top and bottom sections together to form an enclosing protective shell.

2. A protective container as described in claim 1 wherein said top section is identical to said bottom section and is inverted before securement to said bottom section to complete said container.

3. A protective container as described in claim 1 wherein the planes of the sidewalls and endwalls of said pan and trough sections diverge from the planes of said base walls so that said pan and trough sections are of generally trapezoidal shape in cross-section.

4. A protective container as described in claim 1 wherein said sidewalls and endwalls of said pan sections are formed with adjacent portions of each wall section disposed in different planes and alternate portions of each wall section disposed in the same plane to thereby stiffen the sections against twisting and compression.

5. A protective container as described in claim 1 wherein said shock-absorbing means is secured within at least one pan section of said bottom section in such position that the object to be protected when secured thereto does not contact any interior surface of either the pan or trough sections, wherein said shock-absorbing end structures each comprise a thickness of force-resisting but crushable material disposed within each end pan section and extending fully widthwise from the end wall thereof longitudinally inward to a point outward of the position of the end of the object to be protected when the latter is secured within the container.

6. A protective container as described in claim 1 wherein said shock-absorbing means is secured within at least one pan section of said bottom section in such position that the object to be protected when secured thereto does not contact any interior surface of either, the pan or trough sections, wherein said shock-absorbing end structures each comprise a thickness of force-resisting but crushable material disposed within each end pan section and extending fully widthwise from the end wall thereof longidutinally inward to a point outward of the position of the end of the object to be protected when the latter is secured within the container, wherein said top section is identical to said bottom section and is inverted before securement to said bottom section to complete said container.

7. A protective container as described in claim 6 wherein said shock-absorbing end structures further include additional force-resisting but crushable material carried by said end pans between the base walls thereof and the level of the base walls of the adjacent trough sections.

8. A protective container as described in claim 6 wherein the planes of the sidewalls and endwalls of said pan and trough sections diverge from the planes of said base walls so that said pan and trough sections are of generally trapezoidal shape in cross-section.

9. A protective container as described in claim 6 wherein said sidewalls and endwalls of said pan sections are formed with adjacent portions of each wall section disposed in different planes and alternate portions of each wall section disposed in the same plane to thereby stiffen the sections against twisting and compression.

10. A protective container as described in claim 6 further including detent means on the upper surface of said top section and detent means on the lower surface of said bottom section, said detent means being complementally shaped and positioned so that the bottom section detent means internest with the top section detent means when one of said protective containers is stacked on top of another to thereby prevent relative lateral shifting of said containers.

11. A two part protective container comprising a top section and a bottom section and means for fixedly securing said top and bottom sections together to form an enclosing protective shell, said bottom section comprising a pair of colinearly spaced apart pan shaped end sections each having a base wall and end and side walls and at least one pan shaped central section colinear with said end sections, each end section being joined to said at least one central section by a generally U-shaped trough section, said at least one central section and trough sections each having a base wall and side walls and the pan sections walls being absent at the junctures with the trough sections so that said bottom section is open from one end wall to the other between the side walls, the base walls of at least said end sections being coplanar at a first level and the base walls of said trough sections being coplanar at a second and higher level, whereby when said bottom section is seated flatwise on an underlying surface there exists a vertical clearance between that surface and the base walls of said trough sections.

12. A protective container as described in claim 11 wherein said top section is identical to said bottom section and is inverted before securement to said bottom section to complete said container.

13. A protective container as described in claim 11 wherein the planes of the sidewalls and endwalls of said pan and trough sections diverge from the planes of said base walls so that said pan and trough sections are of generally trapezoidal shape in cross-section.

14. A protective container as described in claim 11 wherein said sidewalls and endwalls of said pan sections are formed with adjacent portions of each wall section disposed in different planes and alternate portions of each wall section disposed in the same plane to thereby stiffen the sections against twisting and compression.

* * * * *